US005772278A

United States Patent [19]

Kowalski

[11] Patent Number: 5,772,278

[45] Date of Patent: Jun. 30, 1998

[54] RECLINER CHAIR HAVING WALL-AVOIDING LINKAGE ARRANGEMENT

[75] Inventor: Jerome R. Kowalski, Hickory, N.C.

[73] Assignee: Hickory Springs Manufacturing Company, Hickory, N.C.

[21] Appl. No.: 723,003

[22] Filed: Sep. 30, 1996

[51] Int. Cl.[6] ..... A47C 1/038

[52] U.S. Cl. ..... 297/85

[58] Field of Search ..... 297/68, 85, 84

[56] References Cited

U.S. PATENT DOCUMENTS

| | | | |
|---|---|---|---|
| 3,874,724 | 4/1975 | Ré . | |
| 3,941,417 | 3/1976 | Re . | |
| 3,958,827 | 5/1976 | Re . | |
| 4,071,275 | 1/1978 | Rogers, Jr. . | |
| 4,077,663 | 3/1978 | Cycowicz et al. . | |
| 4,108,491 | 8/1978 | Rogers, Jr. . | |
| 4,337,977 | 7/1982 | Rogers, Jr. et al. | 297/85 |
| 4,350,386 | 9/1982 | Rogers, Jr. . | |
| 4,350,387 | 9/1982 | Rogers, Jr. . | |
| 4,531,778 | 7/1985 | Rogers, Jr. . | |
| 4,805,960 | 2/1989 | Tacker | 297/85 |
| 4,863,215 | 9/1989 | Crum | 297/85 |
| 4,904,019 | 2/1990 | May | 297/85 |
| 5,360,255 | 11/1994 | Cook et al. | 297/85 X |

*Primary Examiner*—Peter R. Brown

*Attorney, Agent, or Firm*—Kennedy Covington Lobdell & Hickman, LLP

[57] ABSTRACT

A wall-avoiding recliner chair has a chair base, a seat and a linkage structure mounting the seat on the base to move between sitting, TV and fully extended positions. The linkage structure utilizes a carrier element in conjunction with a first linkage arrangement mounting the seat on the carrier element and a second linkage arrangement mounting the carrier element on the base. The first linkage arrangement is pivotable with respect to the carrier element to move the seat from the sitting position to the TV position substantially without movement of the carrier element and the second linkage element relative to the base. The second linkage arrangement is pivotable with respect to the base when in the TV position to move the carrier element, the seat and the first linkage arrangement from the TV position to the fully extended position substantially without movement of the carrier element and the first linkage arrangement relative to the seat.

6 Claims, 3 Drawing Sheets

RECLINER CHAIR HAVING WALL-AVOIDING LINKAGE ARRANGEMENT

BACKGROUND OF THE INVENTION

The present invention relates generally to recliner chairs, i.e., chairs of the type having a mechanical arrangement permitting seat and seat back portions of the chair to be moved into a reclined disposition relative to a stationary chair base. More particularly, the present invention relates to such recliner chairs whose mechanical arrangement is operative to move the seat and seat back portions forwardly relative to the base to avoid contact between the seat back and any adjacent wall.

Recliner-type chairs are well known and the mechanical arrangements used therein for accomplishing the reclining motion are diverse and varied. Currently, the more popular types of recliner chairs typically provide three basic positions, a normal non-reclined sitting position with the seat generally horizontal and the seat back substantially upright, a partially reclined position often referred to as a "TV" position wherein the seat and seat back are disposed in a slightly reclined disposition but with the seat back still sufficiently upright to permit comfortable television viewing from the chair, and a fully reclined position wherein the seat back is pivoted toward horizontal into an obtuse relationship with the seat for lounging or sleeping. Most such recliner chairs also include a foot rest coordinated with the mechanical reclining arrangement to be extended forwardly of the seat in the TV and fully reclined positions.

While such recliner chairs have met with substantial popularity, one of the disadvantages of many such chairs is that the seat back in the fully reclined position will contact an adjacent wall unless the base of the chair is moved outwardly away from the wall. To address this problem, various mechanisms have been designed to cause the seat and seat back to move forwardly relative to the chair base while moving from the TV position to the fully reclined position, thereby to avoid contact between the seat back and the wall. One such recliner mechanism, disclosed in Rogers, Jr. U.S. Pat. No. 4,531,778, provides a combination of a mechanical linkage and a roller/track system to accomplish reclining and wall-avoiding movements. While the mechanism described in the Rogers, Jr. patent is mechanically effective for the intended purpose, the combined linkage and track system is not perceived to operate in as smooth and stable a manner as recliner mechanisms comprised entirely of a pivotably interconnected arrangement of mechanical links.

SUMMARY OF THE INVENTION

It is accordingly an object of the present invention to provide a recliner chair having the capability of selective disposition in sitting, partially reclined and fully reclined positions along with wall-avoiding capability without utilizing a roller-and-track arrangement but instead utilizing only a mechanical linkage arrangement.

Briefly summarized, the recliner chair of the present invention which accomplishes the foregoing objective basically comprises a chair base, a seat, and means mounting the seat on the base for movement between a first position wherein the seat is disposed for sitting, a second position wherein the seat is partially reclined relative to the base, and a third position wherein the seat is extended relative to the base beyond the partially reclined second position. In accordance with the present invention, the mounting means comprises a carrier element, a first linkage arrangement mounting the seat on the carrier element, and a second linkage arrangement mounting the carrier element on the base. More specifically, the first linkage arrangement is pivotable with respect to the carrier element for moving the seat from the first sitting position to the partially reclined second position substantially without movement of the carrier element and the second linkage arrangement relative to the base. The second linkage arrangement is pivotable with respect to the base when in the partially reclined second position for moving the carrier element, the seat and the first linkage arrangement from the partially reclined second position to the extended third position substantially without movement of the carrier element and the first linkage arrangement relative to the seat.

In the preferred embodiment, the first linkage arrangement comprises a pair of links pivoted to the carrier element and to the seat at spacings along each thereof for generally translatory motion of the seat between the first sitting position and the partially reclined second position. The second linkage arrangement similarly comprises a pair of link assemblies pivoted at spacings to the base and to the carrier element for generally translatory motion of the seat between the partially reclined second position and the extended third position. Each link assembly basically includes a support link pivoted to the base and a swing link pivoted to the support link and to the carrier element to accomplish such translatory motion.

Preferably, the recliner chair also has a footrest connected with the first linkage arrangement by a lazy tong arrangement for retraction of the footrest in the first sitting position and extension of the footrest relative to the seat in the partially reclined second position and in the extended third position. The recliner chair also preferably includes a seat back linkage arrangement supporting a seat back pivotably relative to the seat for movement between a position generally normal to the seat in the first sitting position and in the partially reclined second position and a position inclined relative to the seat in the extended third position.

DETAILED DESCRIPTION OF THE PREFERRED EMBODIMENT

Figure 1:
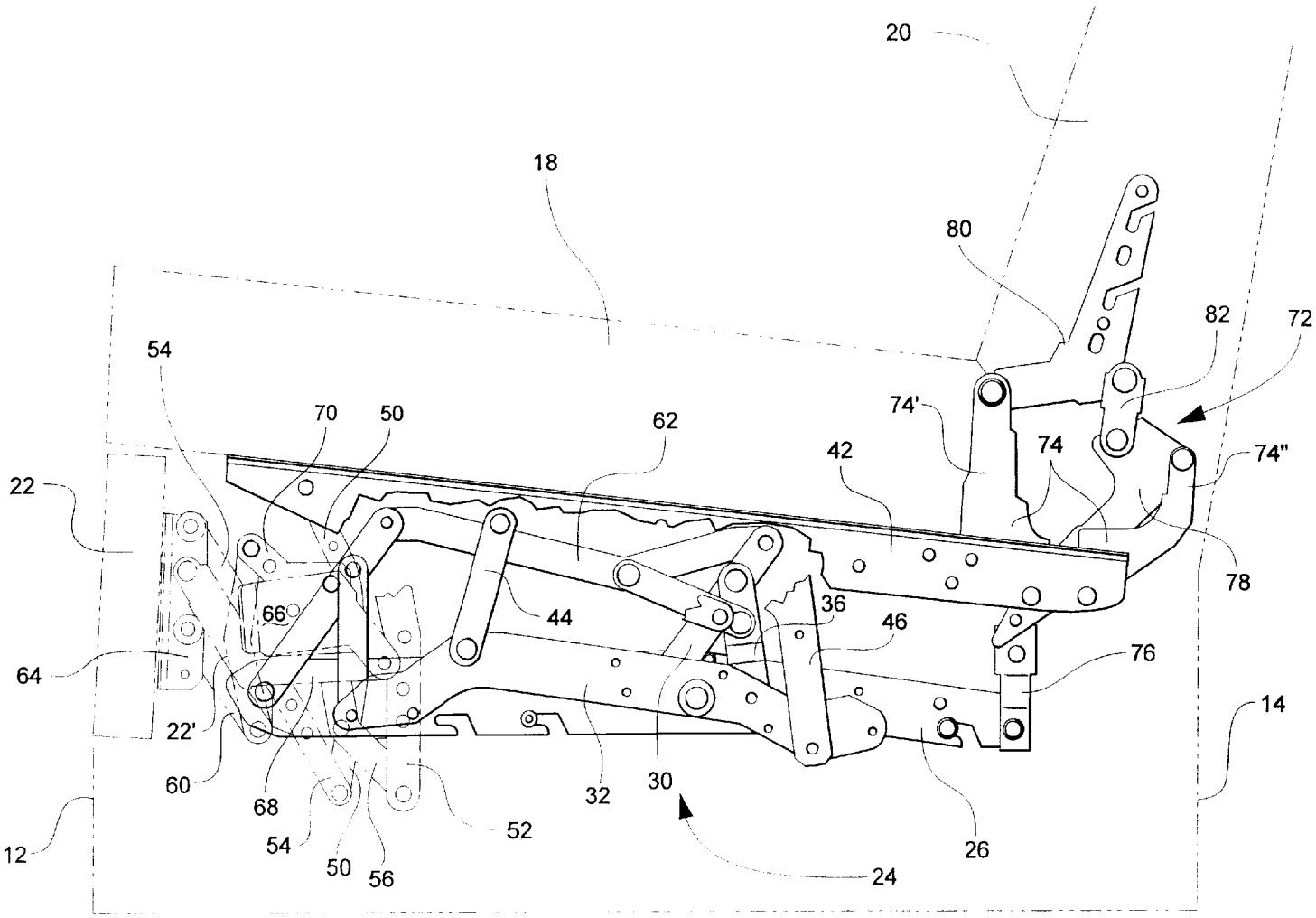
FIGS. 1–3 are side elevational views of a recliner chair in which is mounted the preferred embodiment of the recliner linkage structure of the present invention, illustrating the linkage structure in successive positions in its movement from the first sitting position, shown in FIG. 1, to the partially reclined second position, shown in FIG. 2, to the fully extended third position, shown in FIG. 3, the frame and cushions of the recliner chair being shown schematically in phantom lines for clarity of illustration.

Referring now to the accompanying drawings, the recliner chair of the present invention is generally indicated at 10. The chair 10 basically includes an upholstered chair framework 12 having a stationary floor-standing base 14 with laterally spaced armrests (not shown) between which a seat 18, a seat back 20 and a footrest 22 are movably supported on the base 14 by a linkage structure 24 arranged to articulably actuate and control movement of the seat 18, seat back 20 and footrest 22 between the aforementioned sitting position of FIG. 1, the partially reclined TV position of FIG. 2, and the fully extended position of FIG. 3, as more fully described hereinbelow.

The linkage structure 24 comprises two essentially identical mirror-image linkage assemblies respectively mounted in opposed facing relation to the spaced armrests of the base 14 with the seat 18, the seat back 20 and the footrest 22 each being rigidly affixed to and extending between the two linkage assemblies, whereby the linkage assemblies execute simultaneous identical movements between the sitting, TV and extended positions. As the components of the two linkage assemblies are identical at each side of the base 14, only one linkage assembly at one side of the base 14 is illustrated in the accompanying drawings at 24 and described herein.

Figure 2:
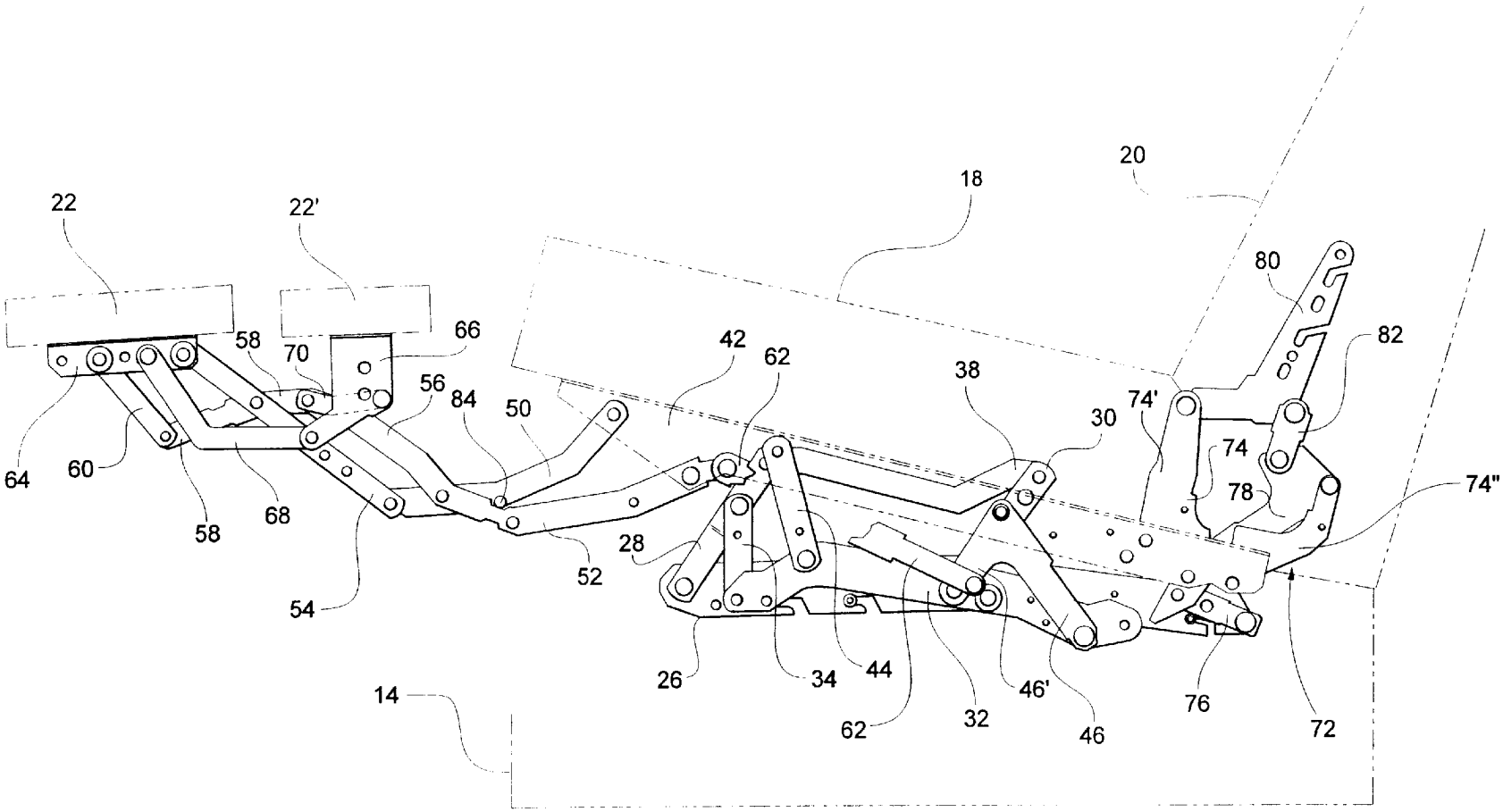
Figure 3:
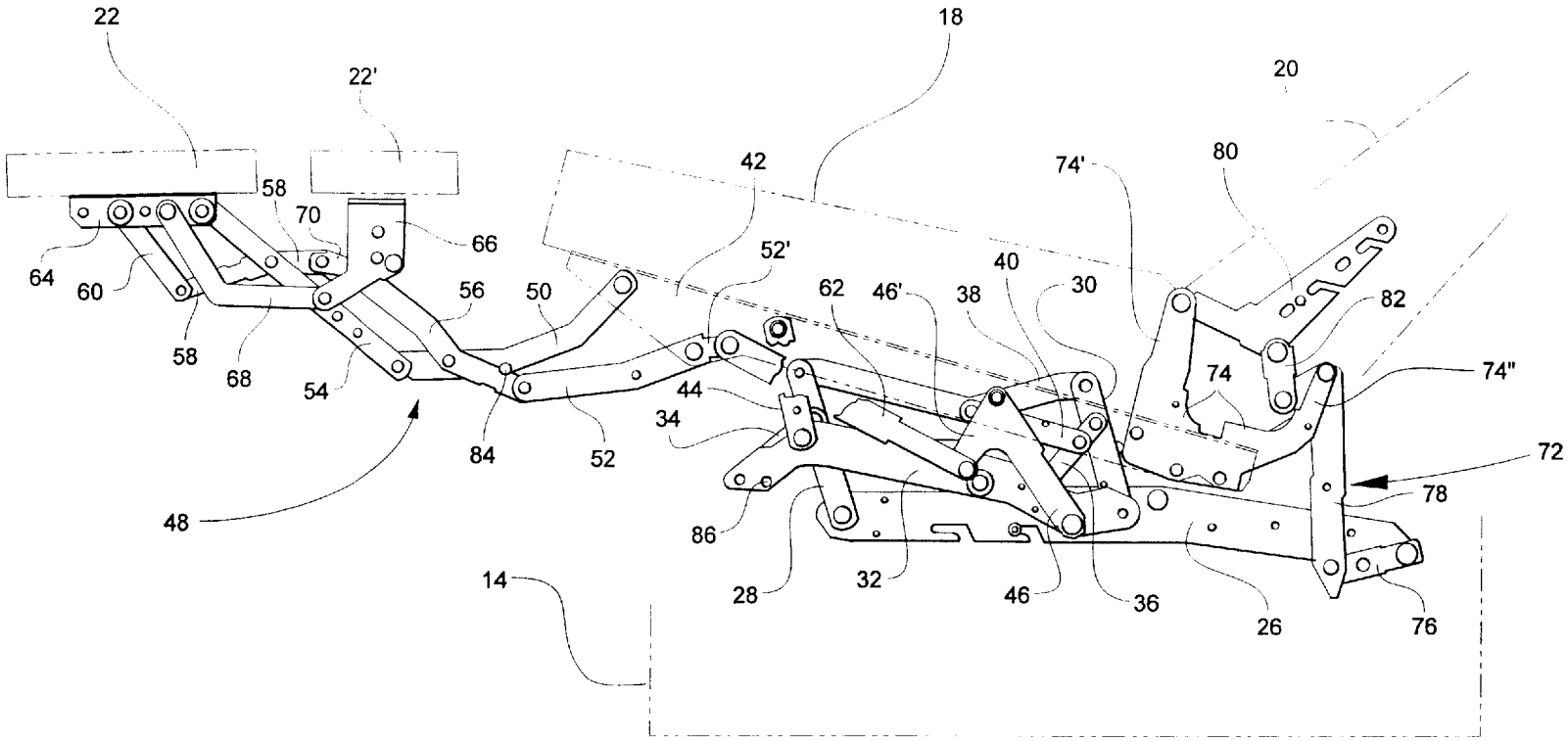

With more detailed reference to FIGS. 1–3, each linkage assembly of the linkage structure 24 comprises a main mounting plate 26 rigidly bolted in a generally horizontal disposition interiorly to the associated armrest 16 of the base 14. A front support link 28 is pivoted at its lower end to the forward end of the mounting plate 26 and, similarly, an identical rear support link 30 is pivoted at its lower end at a rearward spacing midway along the mounting plate 26, the front and rear support links 28,30 extending upwardly in essentially parallel relation. A front swing link 34 is pivoted at its upper end to an intermediate location on the front support link 28 and, similarly, an identical rear swing link 36 is pivoted at its upper end intermediately to the rear support link 30, the swing links 34,36 extending downwardly from the respective front and rear support links 28,30 in generally parallel relation and being pivoted at their respective lower ends at spacings along an elongate carrier link 32 to support the carrier link 32 in generally horizontal disposition laterally alongside the mounting plate 26. One end of a connector link 38 is pivoted to the upper end of the front support link 28 and extends generally horizontally therefrom with the rearward end of the connector link 38 being pivoted to the upper end of the rear support link 30. A control link 40 is pivoted between a medial location along the connector link 38 and a medial location along the rear swing link 36. As an alternative, the connector link 38 could be pivoted intermediately to the rear swing link 36 and the control link 47 could extend from the medial location on the connector link 38 to the upper end of the rear support link 30. In each case, the support links 28,30, the swing links 34,36 and the connector and control links 38,40 act in a parallelogram-like manner to support the carrier link 32 for generally linear horizontal translatory motion forwardly and rearwardly relative to the mounting plate 26 and the base 14, as more fully explained below.

A seat mounting rail 42 is supported on the carrier link 32 by secondary front and rear support links 44,46, the secondary front support link 44 being pivoted at its lower end to the carrier link 32 rearwardly of the front swing link 34 and the secondary rear support link 46 similarly being pivoted at its lower end adjacent the rearward end of the carrier link 32, with the front and rear secondary support links 44,46 extending upwardly from the carrier link 32 and being pivoted at their respective upper ends at spacings along the intermediate portion of the seat mounting rail 42. A lazy tong-type linkage assembly 48 comprised of a pair of drive links 50,52 pivotably interconnected with support links 54,56,58,60 is mounted at the forward end of the seat mounting rail 42 by pivotal attachment of the drive links 50,52 at a spacing from one another. An actuating link 62 is pivoted at one end thereof to a downwardly projecting crank arm portion 46' of the secondary rear support link 46 and extends forwardly therefrom with the opposite forward end of the actuating link 62 being pivotably connected to an end portion 52' projecting from the drive link 52. The footrest 22 is supported at the outward free end of the lazy tong linkage assembly 48 by a support bracket 64 pivoted to the support links 54,60. An auxiliary leg rest 22' is mounted adjacent the footrest 22 on a support bracket 66 mounted to a first auxiliary support link 68 attached to the support bracket 64 and a second auxiliary support link 70 attached to the pivot connection between the support links 54,58.

A seat back linkage subassembly 72 is supported at the respective rearward ends of the mounting plate 26 and the seat mounting rail 42. More specifically, the seat back linkage subassembly 72 includes a U-shaped main support bracket 74 rigidly affixed to the rearward end of the seat mounting rail 42 with the spaced legs 74',74" of the bracket extending upwardly therefrom. The rear bracket leg 74" is connected to the rearward end of the mounting plate 26 by a pair of support links 76,78 pivoted end to end. In turn, an L-shaped mounting bracket 80 affixed to the seat back 20 is pivoted to the forward bracket leg 74' and to the support link 78 by an intermediate connecting link 82.

The operation of the recliner chair 10 and, particularly, of the linkage structure 24 may thus be understood. As shown in FIG. 1, in the sitting position, the linkage structure 24 is fully retracted within the chair base 14 between the laterally spaced armrests 16, wherein the seat mounting rail 42 and the seat 18 are disposed in an essentially horizontal disposition with the seat back mounting bracket 80 and the seat back 20 extending upwardly in generally normal (perpendicular) relation thereto. From the sitting position of FIG. 1, movement of the linkage structure 24 into the TV position of FIG. 2 is accomplished by forward pivoting of the front and rear secondary support links 44,46 with respect to the carrier link 32 and simultaneous coordinated forward pivoting of the seat back support link 76. During such movement, the support links 28,30 and the swing links 34,36 remain stationary whereby, in turn, the carrier link 32 remains essentially fixed relative to the base 14. At the same time, the forward pivoting movement of the rear secondary support link 46 acts through its crank arm portion 46' to drive the actuating link 62 forwardly and, in turn, causes the lazy tong linkage assembly 48 to extend forwardly from the base 14, bringing the footrest 22 and the auxiliary leg rest 22' upwardly into a horizontal disposition disposed forwardly of the seat 18. A stop pin 84 on the drive link 50 engages the support link 56 at the completion of such movement to designate the TV position.

As will be understood, a handle (not shown) may be provided exteriorly on the base 14 and connected in appropriate manner, e.g., through a cable or auxiliary linkage (also not shown), to the linkage structure 24 for operation by a user to manually initiate movement of the linkage structure 24 from the sitting position of FIG. 1 into the TV position of FIG. 2. However, it is also possible for the user to initiate such movements without an actuating handle by exerting bodily force on the seat 18 and seat back 20 while seated in the chair 10.

The linkage structure 24 will be recognized to be of sufficient stability to maintain the TV position as long as the user desires. Alternatively, the linkage structure 24 can be easily extended further from the TV position into the fully extended position of FIG. 3 by pivotal movement of the support links 28,30 and the swing links 34,36 relative to the mounting plate 26 and to one another, causing the carrier link 32, the secondary support links 44,46, the actuating link 62 and the lazy tong linkage assembly 48 to move horizontally forwardly as a unit relative to the base 14. Simultaneously, the forward motion of the seat mounting rail 42 causes the seat back support link 76 to pivot further downwardly relative to the mounting plate 26 and the support link 78 to pivot forwardly about the link 76, which acts through the connecting link 82 to incline the seat back 20 relative to the seat 18. A stop pin 86 projecting laterally from the forward end of the carrier link 32 engages the front swing link 34 at the completion of movement into the fully extended position. As will be understood, from the fully extended position, the linkage structure 24 and the seat 18, seat back 20, footrest 22 and leg rest 22' may be returned to the TV position of FIG. 2 and therefrom to the sitting position of FIG. 1 by reversal of the abovedescribed motions.

As will be recognized, the linkage structure 24 is comprised exclusively of mechanical links which thereby provides the advantage, in comparison to a recliner using a roller-and-track system, of greater stability and rigidity in the coordinated motion of the individual components of the linkage structure and, in turn, enhanced smoothness in the motions executed by the linkage structure. At the same time, the unique provision of a carrier link 32 with separate support link arrangements mounting the carrier link to the base 14 and mounting the seat mounting rail 42 to the carrier link 32 provides the two-fold advantage of, first, defining the three sitting, TV and extended positions and, second, causing the seat mounting rail 42 and the seat 18 to extend substantially forwardly from the TV position into the extended position, thereby enabling the seat back 20 to be reclined while still avoiding an adjacent wall.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A recliner chair comprising a chair base, a seat, and means mounting the seat on the base for movement between a first position wherein the seat is disposed for sitting, a second position wherein the seat is partially reclined relative to the base, and a third position wherein the seat is extended relative to the base beyond the partially reclined second position, the mounting means comprising a carrier element, a first linkage arrangement mounting the seat on the carrier element, and a second linkage arrangement mounting the carrier element on the base, the first linkage arrangement being pivotable with respect to the carrier element for moving the seat from the first sitting position to the partially reclined second position substantially without movement of the carrier element and the second linkage arrangement relative to the base, and the second linkage arrangement being pivotable with respect to the base when in the partially reclined second position for moving the carrier element, the seat and the first linkage arrangement from the partially reclined second position to the extended third position substantially without movement of the carrier element and the first linkage arrangement relative to the seat, wherein the second linkage arrangement comprises a pair of support links pivoted to the base at spacings therealong, a pair of swing links each pivoted between a respective one of the support links and respective spaced locations along the carrier element, and a connector linkage assembly extending between the support links for stabilization thereof, the support links, the swing links and the connector linkage assembly providing generally translators horizontal motion of the seat between the partially reclined second position and the extended third position.

2. A recliner chair according to claim 1, wherein the first linkage arrangement comprises a pair of links pivoted to the carrier element and to the seat at spacings along each thereof for generally translatory motion of the seat between the first sitting position and the partially reclined second position.

3. A recliner chair according to claim 1 and further comprising a footrest and a lazy tong linkage arrangement connecting the footrest and the first linkage arrangement for retraction of the footrest in the first sitting position and extension of the footrest relative to the seat in the partially reclined second position and in the extended third position.

4. A recliner chair according to claim 1 and further comprising a seat back and a seat back linkage arrangement supporting the seat back pivotably relative to the seat for movement between a position generally normal to the seat in the first sitting position and in the partially reclined second position and a position inclined relative to the seat in the extended third position.

5. A recliner chair according to claim 1, wherein the connector linkage assembly comprises a connector link extending between the support links and a control link extending between the connector link and one of the swing links.

6. A recliner chair according to claim 1, wherein the support links extend upwardly from the base and the swing links extend generally downwardly from the respective support links to the carrier element.

* * * * *